US012193550B1

(12) United States Patent
Celedonio

(10) Patent No.: US 12,193,550 B1
(45) Date of Patent: Jan. 14, 2025

(54) CUFF LINK TRAVEL STORAGE DISPLAY DEVICE

(71) Applicant: Leonin Alberto Celedonio, Germantown, MD (US)

(72) Inventor: Leonin Alberto Celedonio, Germantown, MD (US)

( * ) Notice: Subject to any disclaimer, the term of this patent is extended or adjusted under 35 U.S.C. 154(b) by 64 days.

(21) Appl. No.: 18/441,879

(22) Filed: Feb. 14, 2024

(51) Int. Cl.
*A45C 11/04* (2006.01)
*A45C 11/16* (2006.01)
*A45C 13/02* (2006.01)
*A45C 13/10* (2006.01)

(52) U.S. Cl.
CPC ..... *A45C 11/16* (2013.01); *A45C 13/02* (2013.01); *A45C 13/1046* (2013.01)

(58) Field of Classification Search
CPC ..... A45C 11/16; A45C 13/02; A45C 13/1046
USPC ..... 206/6.1, 459.5, 495, 566; 53/467; 383/61.4, 72, 87, 98, 99, 100, 102, 109, 383/111, 117
See application file for complete search history.

(56) References Cited

U.S. PATENT DOCUMENTS 5,244,278 A 9/1993 Robitaille
5,288,150 A * 2/1994 Bearman ..... A45C 3/00 383/117
5,895,118 A * 4/1999 Hensley ..... A45C 9/00 383/117
6,634,041 B2 * 10/2003 Higashi ..... A45F 4/02 5/656
7,784,611 B2 * 8/2010 Gordon ..... B60D 1/486 383/902
9,681,720 B2 6/2017 Davis
11,478,054 B2 10/2022 Nolan Krouse
2004/0016670 A1 1/2004 Lewand et al.
2009/0071849 A1 * 3/2009 Trusiak ..... A47K 5/08 383/117
2010/0155266 A1 6/2010 Nicholson
2012/0241329 A1 9/2012 Gaspari et al.
2015/0230575 A1 8/2015 Gort
2021/0361045 A1 * 11/2021 Wood ..... A45C 13/1046
2023/0232948 A1 * 7/2023 Wang ..... A45C 13/02 150/105

* cited by examiner

*Primary Examiner* — Luan K Bui

(57) ABSTRACT

The present invention, a cufflink specific travel device, is novel in jewelry care. Traditional devices lack innovation and do not address cufflink specific needs. This invention provides a solution to those problems through an innovative device for displaying, transporting, and storing cufflinks in combination with a rollable coiling method. The pouch is a soft textile with a unique coiled flap attached inside. The pouch is finished with a combination of functional and decorative designs in a unique shape. The device provides a cost-effective solution for cufflink care and sits in the palm of a hand.

2 Claims, 3 Drawing Sheets

CUFF LINK TRAVEL STORAGE DISPLAY DEVICE

FIELD

The present invention relates generally to a new package container system, and more particularly, to a jewelry case pouch system that incorporates new features for a container device. The invention further encompasses a new method of display, storage, and transportation of jewelry, in conjunction with varying design elements.

BACKGROUND

Jewelry container devices for cufflinks, predominantly boxes, are typically large bulky cases. They are usually produced from cardboard or wood with a plate glass top, and can serve usually one purpose in displaying cufflinks in a stationary configuration atop a desk or miscellaneous furniture. These devices are typically not portable due to their size, or practical due to their composition, and quite often maybe be hazardous with the splintering of the wood or shattering of the glass. Although other generic jewelry container devices exist, they do not resolve the specific problem of a cufflink unique device.

SUMMARY

The present invention pertains to a novel jewelry device for the care of cufflinks. Traditional devices suffer from a lack of innovation both in size and composition; moreover, they do not address the need of a cufflink specific device. The disclosed device provides a solution to those problems through a convenient apparatus that displays, transports, and stores cufflinks.

The invention features an invertible soft pouch with a cinch top opening, an inner mesh pocket lining, and an attached perforated inner rollable flap for cufflink jewelry insertions. The flap coils within the compact pouch to a diminutive size, but supplies ample storage for numerous cufflinks in a robust and sturdy configuration.

The disclosed exemplary drawings, photos, and related embodiments outline the features of the device. In one drawing the device is shown closed. In another drawing, the device is shown as a partial transparency displaying the inner coiled flap and mesh pocket lining.

In another drawing the device is shown with the flap uncoiled, while in yet another drawing the device is depicted inverted. The combined drawings and photographs of the prototype device depict the overall method of function, and the associated ornamental design elements.

In summary, the cufflink display, storage, transport device described herein offers a revolutionary approach to cufflink jewelry care. This summary provides a brief but comprehensive insight. Further objects, features, advantages, and properties of the device according to the present application will be made clear from the detailed description.

BRIEF DESCRIPTION OF THE DRAWINGS

In the following detailed portion of the present description, the teachings of the present application will be explained in more detail with reference to the example embodiments shown in the drawings and black and white prototype photos, in which.

DETAILED DESCRIPTION

The present invention pertains to a cufflink travel, storage, and display pouch, a novel jewelry apparatus alleviating the burden of cufflink jewelry care. The care of cufflink jewelry is best achieved through a device that can safeguard numerous cufflinks simultaneously; that can also allow for a visibly unfettered display of various cufflinks, and, finally can allow for quick or long-term storage, and secure transportation of the cufflinks. The current invention accomplishes this through its unique attributes and the associated method of item storage.

One of the central features of the device is its pouch. The pouch in question here maybe composed of any fibrous textile fabric, or an animal-hide product, that can be manipulated, sized, and prepared for commercial stitching. The pouch may be formed through any combination of rectangular sections (notched to provide the pouch girth), and after proper sizing and stitching, sewn on three sides to form the outline of the invention. Mesh, forming the inner mesh pocket, of any elastic textile fabric should also be attached to the inner pouch sections before assembly.

Figure 1:
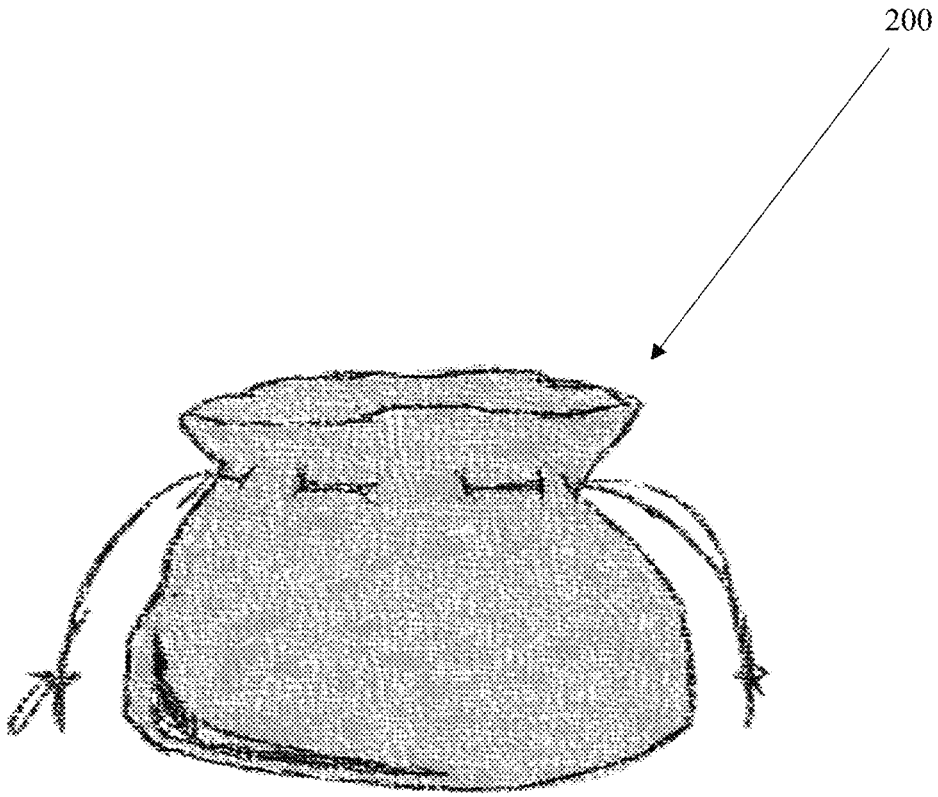
FIG. 1 is a frontal view drawing of a device.

During sewing assembly, the initial preparation of the pouch sections will be given a proper seam allowance on all sides and an enhanced hem allowance at the top opening for insertion of a cinching textile cord device. The cinch cord closure maybe threaded into the top seam at any time during assembly. FIG. 1, is a frontal view drawing of the device. This embodiment, 200, shows the pouch fully closed.

The inside of the pouch has a perforated flap attached inside, which may be composed of any fibrous textile fabric or animal-hide product, that can be manipulated, sized, and prepared for commercial stitching. The selected material for the flap should be somewhat malleable, allowing for coiling and storage within the pouch, and perforated with numerous openings to insert cufflink jewelry. The flap section should not exceed the width of the pouch sections, and should be attached or sewn to the inner base of the pouch sections unassembled. The flap should also surpass the overall length of the pouch when exposed and uncoiled, to maximize overall capacity.

Figure 2:
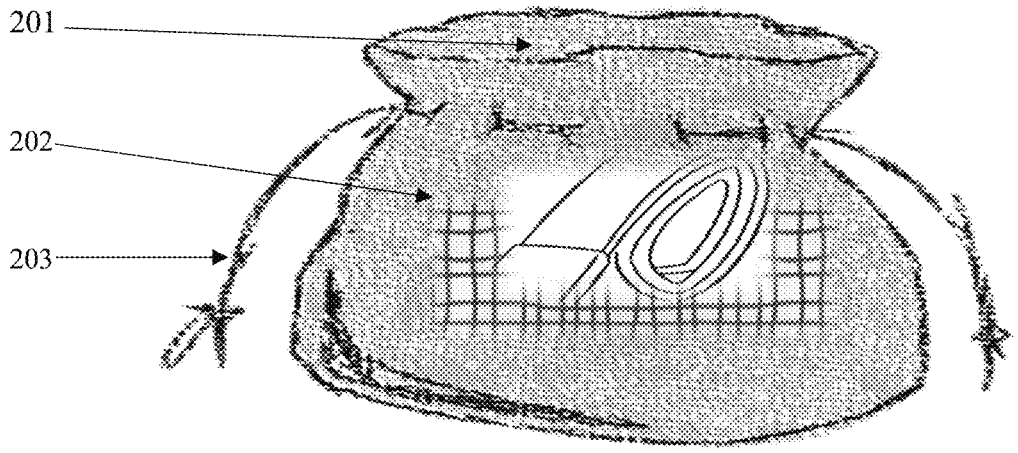
FIG. 2 is a frontal transparency view drawing of inner portions of a device.
Figure 3:
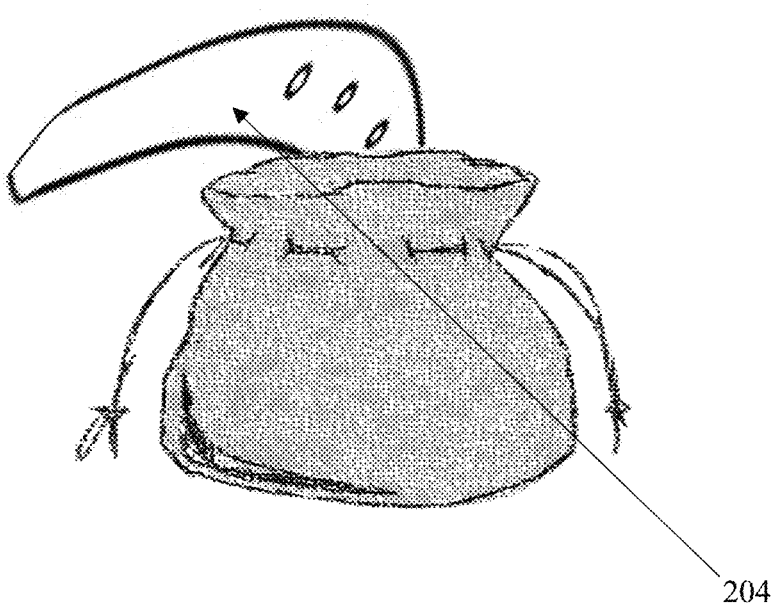
FIG. 3 is a frontal view drawing of the flap of a device.
Figure 4:
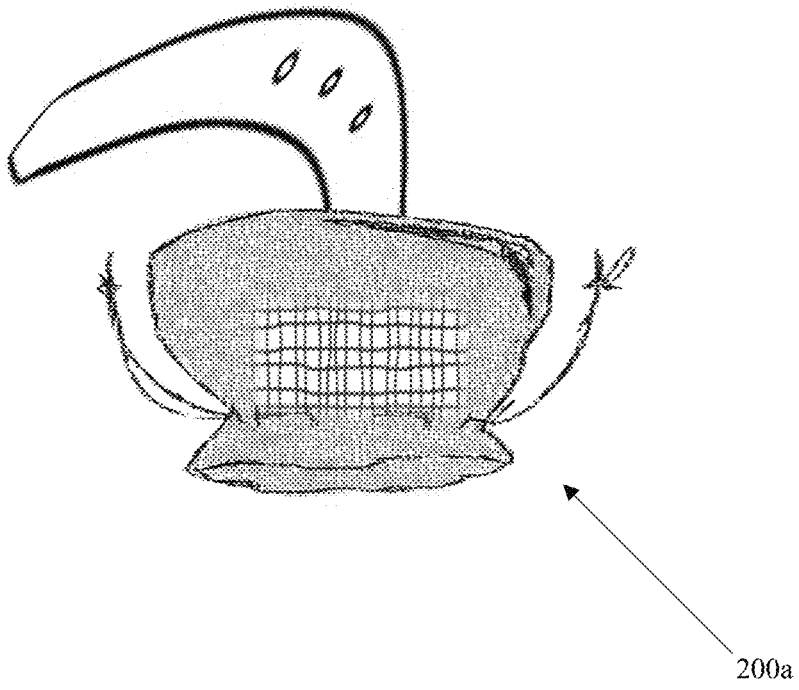
FIG. 4 is a frontal view drawing of an inverted device.

FIG. 2 is a frontal view drawing of the cinch opening of the device with an internal transparency view. In this embodiment of the device, 201 indicates the cinch closure, 202 indicates the pouch assembled with flap coiled, and 203 shows the cinch cord device. FIG. 3 is a depiction of the device with exposed flap. In this embodiment, 204 shows the flap protruding from the top. FIG. 4 is a frontal view drawing of the device. This embodiment, 200*a*, shows the device fully inverted. The overall assembly of the sections, flap, and top seam should all use serger stitches or similar re-enforced stitching with a substantial tensile thread for maximum strength.

The assembly of the invention through adroit seamstery work should also accomplish certain unique design elements. The horizontal stitched sections of the pouch add to its unique bulbous sloped shape and tapered appearance. The ornamental horizontal stitched borders, logos, and monograms can be achieved through proper stitch and thread selection available in commercial machinery.

Moreover, this application outlines a new method unique to jewelry case systems. First the prior art search does not reveal any invention specifically designed for the exclusive storage of cufflinks. This emphasizes the unique quality in the invention since it focuses on one item of jewelry. Secondly, the uniquely claimed method employed here involves coiling or rolling the cufflinks onto themselves while secured on the flap. This process creates a tight roll which can then be re-inserted into the pouch; cinching and or knotting the closure device atop the pouch provides further security.

Figure 5:
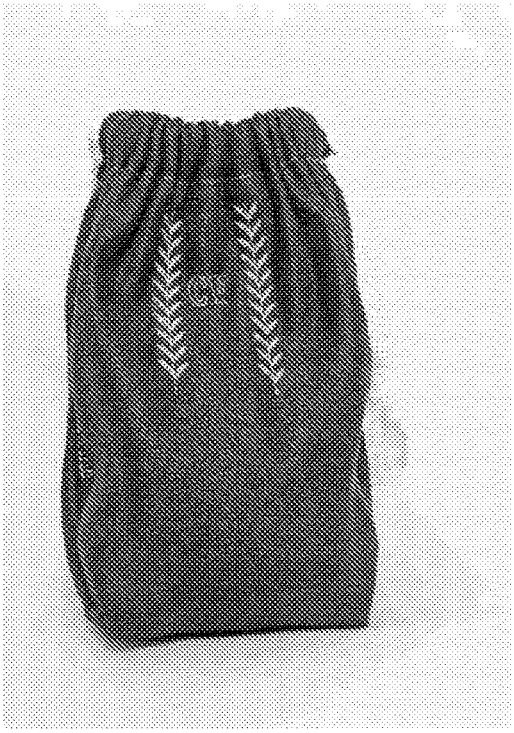
FIG. 5 is a black and white frontal photo of the device prototype.
Figure 6:
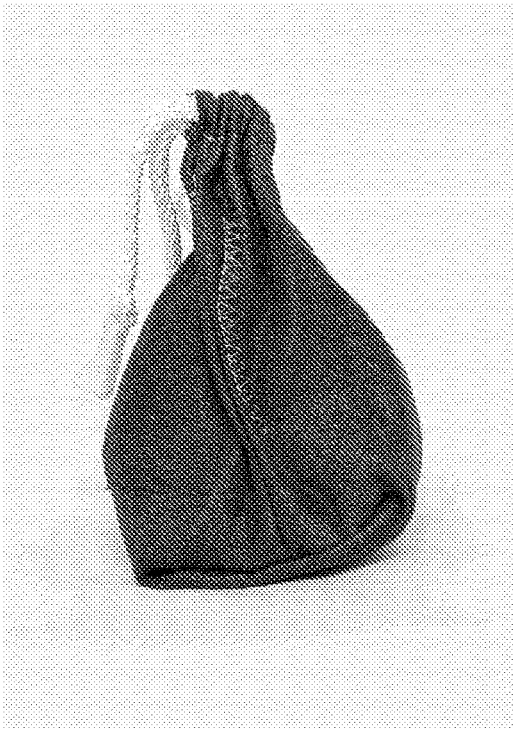
FIG. 6 is a black and white frontal photo of the device prototype.
Figure 7:
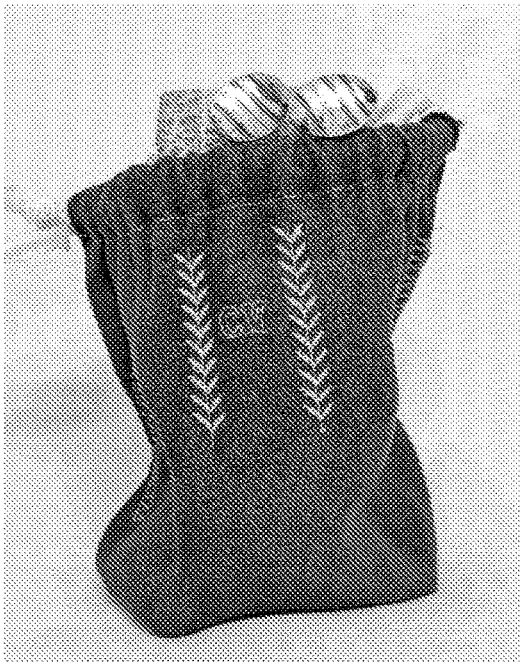
FIG. 7 is a black and white side photo of the device prototype.
Figure 8:
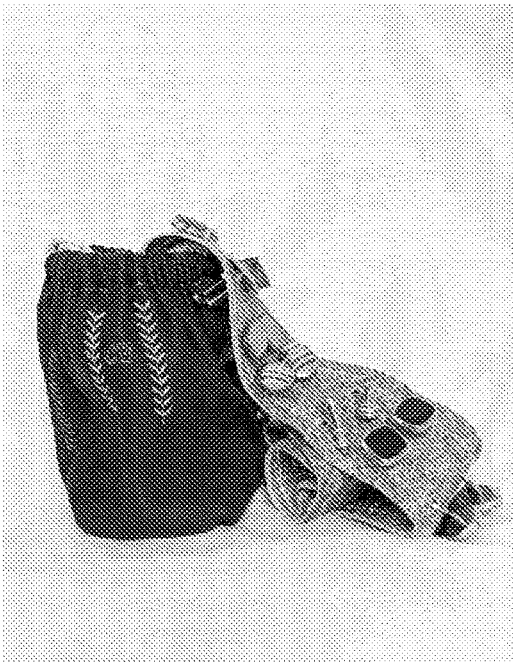
FIG. 8 is a black and white photo of the device prototype flap.

To best illustrate hybrid design elements and methods of the invention, photographs also accompany the application. FIGS. 5 and 6 are prototype photographs of the invention highlighting its sloped pouch curvature tapered towards the top opening, while bulbous and squat at the bottom. FIGS. 7 and 8 are prototype photographs which best depict the functional and ornamental stitching and monograms, along with the cufflink rolling method previously outlined.

The preferred embodiment of the invention can be achieved through a precise application of the teachings in the previous paragraphs. The best execution of a novel small pouch carrier for cufflinks demands that the device be diminutive in overall size. As is seen in FIGS. 4 through 8, the functional protype of the device as assembled has overall dimensions not exceeding five inches by three inches by four inches (H×W×D), while the flap section should not exceed the overall width of the pouch sections. In this configuration the flap, uncoiled, is five times the length of the pouch. Therefore, these proportions are optimal in creating a device that can house approximately twenty pairs of cufflinks while retaining a small footprint.

Moreover, the best choice of textiles, materials, threading, and fabrics for the device are commercial grade items (i.e. suede pouch and leather flap), to facilitate a manageable production and overall cost. While alternative embodiments and or other versions or configurations of the invention may follow, varying in size, scope, material, and automatic flap retractability features, all currently under consideration, the aforementioned production is the best method for this application. The invention claims that subsequently follow are drafted to provide broad protections for future iterations of the application.

In summary, the cufflink display, storage, transport device provides a cost-effective solution for cufflink care. Cufflinks are notoriously misplaced or lost, and large collections of cufflinks lack convenient portability, visibility, and overall storage. This invention resolves those woes with a potent little device which sits in the palm of a hand.

The invention claimed is:

1. A method of displaying jewelry comprising:

a jewelry case device pouch having an opening at one end; a closure device near an edge of the opening of said jewelry case device pouch; a perforated flap has numerous perforations and the perforated flap attached to the inside of said jewelry case device pouch; a mesh lining attached to the inside of said jewelry case device pouch for displaying jewelry by inverting said jewelry case device pouch and inserting cufflinks jewelry in the perforations of an uncoiled said perforated flap for displaying.

2. A method of storing and transporting jewelry comprising:

a jewelry case device pouch having an opening at one end; a closure device near an edge of the opening of said jewelry case device pouch; a perforated flap has numerous perforations and the perforated flap attached to the inside of said jewelry case device pouch; and a mesh lining attached to the inside of said jewelry case device pouch for storing and transporting jewelry by inserting cufflinks jewelry in the perforations of an uncoiled said perforated flap, re-coiling said perforated flap, and re-inserting coiled said perforated flap into said jewelry case device pouch for storage and transportation.

* * * * *